US005918680A

United States Patent [19]

Maranghides

[11] Patent Number: 5,918,680

[45] Date of Patent: Jul. 6, 1999

[54] WATER SPRAY COOLING SYSTEM FOR EXTINGUISHMENT AND POST FIRE SUPPRESSION OF COMPARTMENT FIRES

[75] Inventor: Alexander Maranghides, North Beach, Md.

[73] Assignee: The United States of America as represented by the Secretary of the Navy, Washington, D.C.

[21] Appl. No.: 08/804,044

[22] Filed: Feb. 26, 1997

[51] Int. Cl.[6] ..... A62C 3/00

[52] U.S. Cl. ..... 169/46; 169/16

[58] Field of Search ..... 169/46, 16

[56] References Cited

U.S. PATENT DOCUMENTS 5,588,493 12/1996 Spector .
5,845,714 12/1998 Sundholm ..... 169/46

OTHER PUBLICATIONS

Black et al., "Real Scale Halon Replacement Testing Aboard the ex–USS Shadwell: Post Fire Suppression Compartment Characterization", *Halon Options Technical Working Conference*, May 7–9, Albuquerque, New Mexico (1996).

Maranghides et al., *HOTWC*.95, pp. 109–124, May 1995.
Murrel et al., *HOTWC*.95, pp. 369–378, May 1995.
Nickolaus, D., *HOTWC*.95, pp. 379–389, May 1995.
Back, G.G., *HOTWC*.95, pp. 391–396, May 1995.
Wighus et al., *HOTWC*.95, pp. 397–409, May 1995.
Darwin et al., *HOTWC*.95, pp. 411–422, May 1995.
Pepi et al., *HOTWC*.95, pp. 423–447, May 1995.
Ural et al., *HOTWC*.95, pp. 449–459, May 1995.
Finnerty et al., *HOTWC*.95, pp. 461–471, May 1995.
Maranghides et al., Halon Options Technical Working Conference, May 7–9, 1996.

*Primary Examiner*—Gary C. Hoge
*Attorney, Agent, or Firm*—Thomas E. McDonnell; Barry A. Edelberg

[57] ABSTRACT

A water spray mist is used to cool a compartment fire before discharge of a gaseous fire suppression. As a result, less water and less fire suppression agent is needed than required with conventional method of suppressing compartment fires. The water spray may be continued for a short time after initial discharge of the fire suppression agent, and may be restarted after the fire has been extinguished. Also, the present invention reduces the levels of toxic and corrosive gases in compartment created during the suppression of compartment fires by the use of a gaseous fire suppression agent.

12 Claims, 4 Drawing Sheets

WATER SPRAY COOLING SYSTEM FOR EXTINGUISHMENT AND POST FIRE SUPPRESSION OF COMPARTMENT FIRES

BACKGROUND OF THE INVENTION

1. Field of the Invention

The present invention relates to generally to the control and extinguishment of fires, and more particularly, to the control and extinguishment of compartment fires.

2. Description of the Background Art

Compartment fires, unlike open air fires, have limited access to the outside environment. This limited access restricts the transfer of heat and fumes with the environment. Therefore, compartment fires are often extremely hot and may quickly contaminate the affected compartment with dangerous levels of toxic fumes. Additionally, compartment fires have the potential to spread quickly throughout the compartment. Moreover, the restricted venting of a compartment to the outside, while it allows sufficient oxygen to maintain the fire, may prevent combustible fuel in the compartment from cooling sufficiently quickly to prevent post suppression reignition. Thus, compartment fires must be rapidly and thoroughly extinguished to minimize loss of life and/or property.

Many compartments made for housing combustibles include a fire suppression system. The most widely accepted fire suppression system for fires uses fluorinated bromohydrocarbons such as Halon™. Halon™ performs exceptionally well at fully extinguishing fires and preventing post suppression reignition, with few toxic byproducts being generated during fire suppression. Nevertheless, the manufacture of fluorinated bromohydrocarbons has been banned because of the threat they pose to the ozone layer. Thus, other gaseous fire suppression agents have been substituted for Halon™.

Generally, these other gaseous fire suppression agents have lacked the qualities of Halon™. Compared with Halon™, many exhibit poor fire suppression efficiency, poor heat transfer; and poor reignition suppression. Because of their decreased efficiency, larger amounts of these substitute agents must be stored in fire suppression systems. This requirement for larger amounts of gaseous fire suppression agents increases the expense of the system and the space it occupies. Additionally, because of their relatively decreased fire suppression efficiency, more of these gaseous fire suppression agents must react with the flame to break the chain reaction of combustion and suppress the fire. Unfortunately, this increased reaction of gaseous fire suppression agents with the flame produces increased quantities of toxic and corrosive byproducts. Further, the cooling ability of many substitute gases is significantly less than that of Halon™. Consequently, the risk of post suppression reignition increases.

Water mists have also been used for the suppression of compartment fires. While these system have reduced toxicity problems compared with gaseous fire suppression agents, they have several drawbacks. Because water mist does not behave completely like a gas, it may not reach all areas within a compartment. Thus, great care must be taken to assure that all areas within the compartment may be accessed by the spray. Also, water mist must be sprayed under extremely high pressures of about 250 psi or more. These pressures require specialized high pressure plumbing, thus increasing the expense of the system and limiting the ability to retrofit a previously existing compartment with a water mist system. Also, water mist systems require large amounts of water to extinguish a fire. The large weight and bulk of water, compared to gaseous fire suppression agents, makes storing the required large amounts of water troublesome. Because of these storage problems, designers may reduce the safety margin of these systems to minimize the amount of water that must be stored. Current systems which employ water and a gaseous propellant require high pressure and large amounts of both water and gaseous propellant.

SUMMARY OF THE INVENTION

Accordingly, it is an object of this invention to suppress compartment fires without requiring the use of gaseous fluorinated bromohydrocarbon fire suppression agents.

It is another object of the present invention to suppress compartment fires while minimizing the generation of toxic fumes from the resulting from use of gaseous fire suppression agents.

It is a further object of the present invention to suppress compartment fires without the use of large amounts of water, and without the use of highly pressurized water.

These and additional objects of the invention are accomplished by a system in which a water droplets are initially sprayed into a compartment fire for a sufficient amount of time to greatly reduce the ambient compartment temperature. The amount of water is not sufficient to extinguish the fire. After water has significantly reduced the ambient compartment temperature, the compartment is flooded with a gaseous suppression agent.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements, wherein.

DESCRIPTION OF THE PREFERRED EMBODIMENTS

Figure 1:
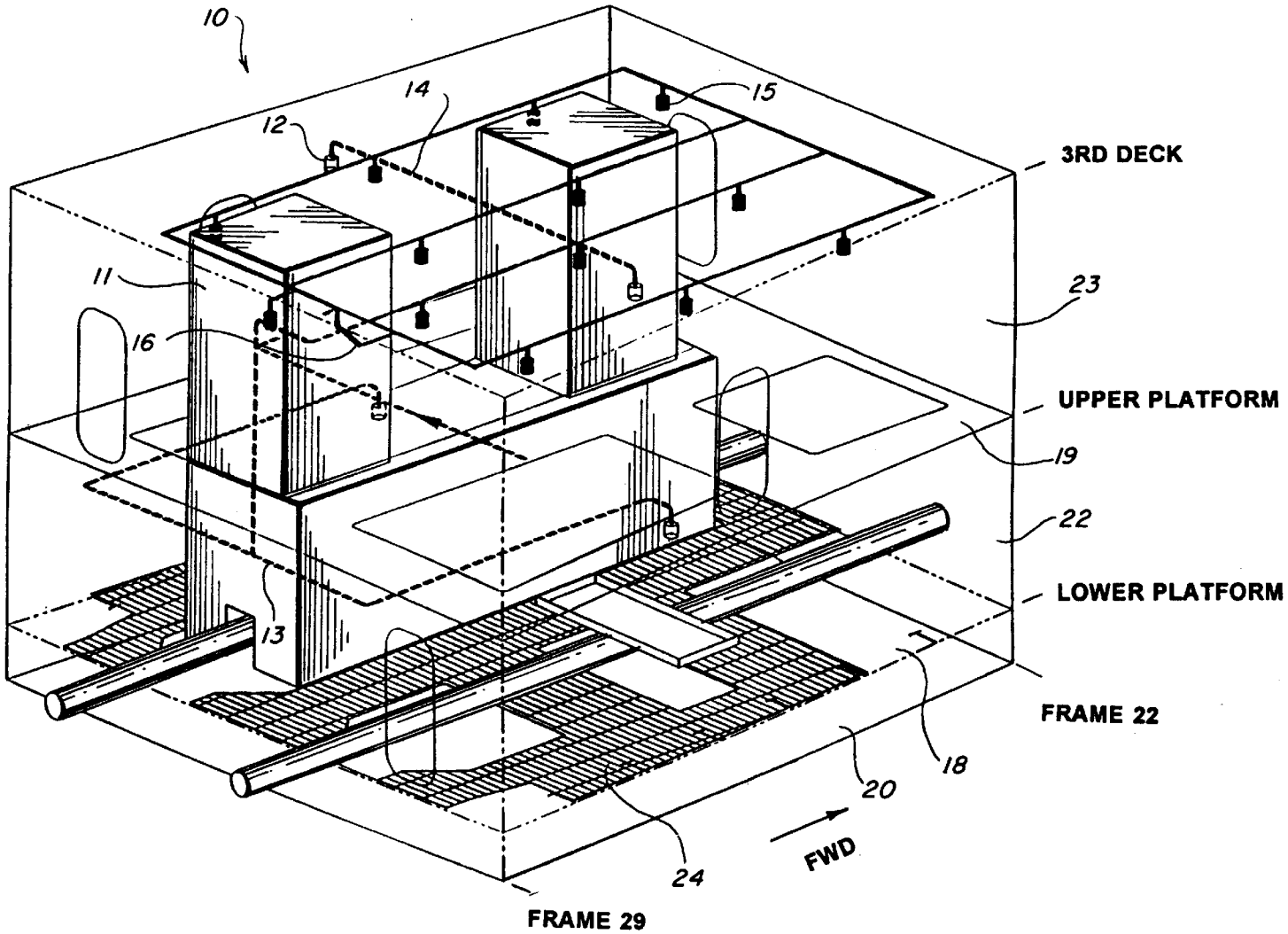
FIG. 1 shows the layout of a facility in which an embodiment of the present invention was tested.

Unlike water mist extinguishing systems, the present invention user water not to extinguish the fire, but to enhance compartment cooling, reduce fire/agent decomposition byproducts generation, scrub generated decomposition byproducts, enhance reignition protection, and facilitate compartment reclamation procedures. Because the present invention uses water for other than fire extinguishment, the water need not be applied as a mist under high pressure. Instead, before application of the gaseous fire suppression agent, water is sprayed onto the compartment fire at a pressure of about 40 to about 150 psi. More typically, the water is sprayed under a pressure of about 40 to about 100 psi. Most typically, a water pressure of about 40 to about 80 psi will be employed. Typically, the present invention uses a water spray in which a majority of the water droplets have a diameter of about 100 to about 200 $\mu$m.

The pressure, droplet size, and coverage determine the application rate of water. Typically, this application rate is about 0.0029 to about 0.009 gallons per minute per cubic foot (ggm/ft$^3$ or g/min/ft$^3$) compartment space.

Typically, the water is discharged downward onto the fire from a nozzle. Generally, this nozzle may extend at or just below the ceiling of the compartment, or it may be positioned along a sidewall of the compartment. Preferably, the water nozzles are positioned above the level of any combustibles in the compartment. Also, even though the ultimate direction of water discharge is downward (due to the influence of gravity), the initial direction of discharge is not critical provided that the nozzles provide reasonably uniform coverage of the compartment. Throughout the present specification and the claims that follow, any reference to a downwardly directed discharge or spray of water refers to the ultimate, not the initial, direction of discharge, unless otherwise stated explicitly.

Before the fire suppression agent is applied, sufficient water is sprayed in the compartment to reduce the ambient compartment temperature to below 100° C. (In accordance with art-recognized terminology, the term "ambient compartment temperature" does not include the flame or the immediately surrounding air, which will obviously be much hotter than the remainder of the compartment.) Typically, no more than the amount of water needed to reduce the ambient compartment temperature to between about 100° C. and about 20° C. is sprayed before application of the gaseous fire suppression agent. More typically, only the amount of water needed to reduce the ambient compartment temperature to between about 60° and about 35° is sprayed before application of the gaseous fire suppression agent. Most often, only the amount of water needed to reduce the ambient compartment temperature to between about 60° and about 40° is sprayed before application of the gaseous fire suppression agent.

This cooling of the compartment before addition of the gaseous fire suppression agent greatly reduces the generation of toxic byproducts, such as HF, from the reaction of the gaseous fire suppression agent with the flame. Continuation of the water spray after application of the gaseous fire suppression agent scrubs the compartment, further reducing the concentration of gaseous byproducts.

Typically, best results are obtained by continuing the water spraying, at the application rates, pressures, and droplet sizes taught herein, after the initial discharge of the gaseous fire suppression agent until either discharge of the gaseous fire agent is complete or until the fire has been extinguished, whichever is longer.

For compartment fires of a typical size and temperature, such as that described in the EXAMPLES section below, water spraying will usually occur over a period of up to about three minutes (inclusive), and at least about 20 sec, before initial discharge of the gaseous fire suppression agent until up to about 2 minutes (inclusive), and most often 10 or more seconds, after initial discharge of the gaseous fire suppression agent.

Obviously, nozzle coverage should for the water spray should be designed to provide the most uniform compartment cooling practical. The optimum number of nozzles per area of floor space will depend on nozzle design, the number of tier of nozzles per unit compartment height, and the desired safety margin. The design of the water nozzle is not critical so long as the water nozzle supplies appropriately size water droplets at the pressures and water flow rates used according to the present invention, as well as reasonably uniform cooling given the selected distribution of nozzles within the compartment.

The water spray system used in the method of the present invention may be tiered. In one typical design, with one nozzle per 55 ft$^2$ floor space and 120 degree full cone water mist nozzles, one tier for a compartment height of 30 ft or less was sufficient.

Generally, for the present invention, water spraying for a period of from 1 min before to 1 min after initial discharge of the gaseous agent uses a total of about 2.5 to about 9 gallons per 1000 ft$^3$ of compartment volume. An additional water spray just before venting further reduces the concentration of gaseous byproducts and also minimizes the risk of reignition. This volume will vary depending upon the actual time the $H_2O$ is applied. Actual time of application will vary depending on flame temperature, water availability, and concerns over collateral damage.

Also, depending upon water availability and concerns over collateral damage, additional water may be sprayed after extinguishment of the fire to both further reduce the possibility of reignition upon venting and to further scrub the compartment of toxic combustion byproducts. Additionally scrubbing, however, is not required.

The water spray system used in the present invention can rely upon water from a standard water tank, a standard water main, a standard firemain, or a standard standpipe. Thus, the system may be easily retrofit into existing fire suppression systems.

Although not necessary, water sprayed in accordance with the present invention may include additives, such as alkali carbonates, salts, and foaming agents, to enhance fire suppression performance. Nevertheless, the inclusion of these additives may unnecessarily increase the complexity and expense of the fire suppression system of the present invention.

Any gaseous fire suppression agent may be used in conjunction with the present invention. Typical gaseous fire suppression agents include perfluorobutane ($C_4F_{10}$); dichlorotrifluoroethane (4.75%) ($CHCl_2CF_3$)/chlorodifluoromethane (82%) ($CHClF_2$)/chlorotetrafluoroethane (9.5%) ($CHClFCF_3$)/isopropenyl-1-methylcyclohexane (3.75%); chlorotetrafluoroethane ($CHClFCF_3$) ; pentafluoroethane ($CHF_2CF_3$); heptafluoroethane ($CF_3CHFCF_3$) ; trifluoromethane ($CHF_3$); hexafluoropropane ($CF_3CH_2CF_3$); trifluoroiodide ($CF_3I$); argon (99.9%); nitrogen (52%)/argon (40%)/carbon dioxide (8%); and nitrogen (50%)/argon (50%) (all percents stated by volume throughout the specification and claims, unless otherwise stated). Application of the gaseous fire suppression agent begins just after the ambient compartment temperature cools to the required extent by the water, and is continued until the fire is extinguished.

The discharge of the water spray and the gaseous fire suppression agent may be controlled automatically, for examples via temperature sensors and/or timers (with or without microprocessor control) or manually. Obviously, the present invention requires that the water spray and gaseous agent can discharged independently of each other.

Having described the invention, the following examples are given to illustrate specific applications of the invention including the best mode now known to perform the invention. These specific examples are not intended to limit the scope of the invention described in this application.

EXAMPLES

The test compartment 10 aboard the ex-USS SHADWELL was located at the 4th deck upper and lower levels between Frames 22 and 29 with catwalks on both levels (FIG. 1). The approximate dimens of the space were 8.5 m (28 ft) long from frames 22 to 29, 6.1 m (20 ft) high from keel to 3rd deck and 8.5 m (28 ft) wide (port to starboard) at frame 29 narrowing to 7 m (23 ft) wide at frame 22. The enclosed volume was approximately 395 $m^3$ (13,950 $ft^3$) . Lower and upper horizontally disposed platforms (solid plates with openings therein) 18 and 19, respectively, partitioned this volume into bilge 20 and lower and upper tiers 22 and 23, respectively. Lower platform 19 also included grating 24 to permit ready drainage into bilge 20. With the LM-2500 gas turbine mock-up 11 occupying approximately 7% of the air space, the adjusted compartment volume became 370 $m^3$ (13,000 $ft^3$). The primary supply and exhaust ventilation system (not shown) in the test space provided approximately 55 air changes per hour. A second exhaust system, the acid exhaust system (not shown), was used for venting decomposition products.

The nomenclature used to identify a location in the test compartment, e.g., (4-22-3: 0.6 m), was level first (4 or 5 for upper or lower) followed by the frame number (22–29) and then by its athwart ship position (0–4). Zero (0) refers to centerline, 1 and 3 to starboard, and 2 and 4 to port, with 3 and 4 being farthest away from centerline. In general, the height was expressed in meters from the level's deckplate. Thermocouple tree heights, however, were all measured from the lower level deckplate.

AGENT AND WATER SPRAY COOLING SYSTEMS

The two gaseous agent extinguishing systems used (FIG. 1) in the tests described below were designed by MPR with the computer code TFA. Bird et al., *Proceedings of the Halon Options Technical Working Conference*, May 3–5, 1994, Albuquerque, N.Mex., pp. 95–103, the entirety of which is incorporated herein by reference for all purposes. Each system, one for HFP and one for Halon 1301, consisted of four discharge nozzles 12 divided into two tiers. These two systems were disposed parallel, alongside and in close proximity, to each other, are represented in FIG. 1 as gaseous agent delivery system 13 (for simplification, only one set of four nozzles shown in FIG. 1).

The Halon 1301 system used standard Navy 4 hole (horizontal-cross) nozzles. The HFP discharge system used similar nozzles. However, because of the increased agent volume required to deliver effective concentrations of HFP, the nozzle diameters were larger than the standard Navy. All nozzles in all tests were oriented in the forward/aft position.

The Water Spray Cooling System (WSCS) 14 was made out of 1 inch stainless steel tube and compression fittings. The looped system had 13 TF10FC nozzles 15, manufactured by Bete Fog Nozzle, Inc. The nozzles have a 120° degree full cone mist pattern. The brass nozzles had ¼ inch male pipe connections. The WSCS was located in the compartment overhead just below the overhead stiffeners. Water for the WSCS was supplied by a 1½ inch standpipe connection 16 to the firemain (not shown). The WSCS Application Rate (WSCSAR) for Class A fires (Grimwood, Paul T., *FOG Attack*, FMJ International Publications Ltd., United Kingdom, 1992, p. 88., the entirety of which is incorporated herein by reference for all purposes) was determined by:

$$\text{WSCSAR(gpm)}=\text{Compartment Volume}(ft^3)/270$$

This WSCSAR was then doubled for Class B fires. *U.S. Navy Salvage Ship Manual*; Volume 3 (Firefighting and Damage Control), S0300-A6-MAN-030, Aug. 1, 1991, pp. 3–35, the entirety of which is incorporated herein by reference, for all purposes. For a Class B fire in a compartment volume of 13000 $ft^3$, the WSCSAR is 96 gpm. The WSCS flow rates were controlled by the firemain pressure. Using the system of the present invention, the WSCSAR according to the above equation war far greater than that actually required. Thus, in Example 1, the system delivered 60 gpm at 80 psi, about 63% of the 96 gpm recommended according to the above equation.

The conditions in Example 1 are summarized below:

WSCS Application Rate=0.005 gallons per minute per floodable volume (gpm/$ft^3$)

WSCS Initiation Time=60 seconds prior to agent discharge

WSCS Application Duration=120 seconds

Droplet Size=100–200 microns in diameter

Nozzle Type=120 degree full cone water mist nozzles (Bete Fog Nozzle, Inc. Type TF10FC or equivalent)

Size System (number of tiers)—1 tier system

Nozzle Coverage (number of nozzles)=55 $ft^2$ of floor area per nozzle (13 nozzles)

Activation Method=Manual

Water Source: Firemain/Standpipe connection

INSTRUMENTATION

The suppression agent discharge systems were instrumented to measure temperature and pressure at each of the 4 nozzles as well as 2 locations in the piping. Pressures were also measured at one cylinder valve and check valve on the manifold. One bottle was attached to a load cell to measure mass loss. In addition, the test space was instrumented to measure gas, fire and bulkhead temperatures. Compartment and fuel pressures were also monitored. A continuous gas sampling system measured oxygen, carbon dioxide, carbon monoxide, and agent concentration at 2 locations in the space, and in the supply and acid exhaust ducts. Grab samples were taken at specified times and locations during each test. One type of grab sample (4 locations) was analyzed using a Gas Chromatograph (GC) to determine agent, oxygen, carbon dioxide and carbon monoxide concentrations. The other type of sample (4 locations) was analyzed using an Ion Chromatograph (IC) to quantify the concentration of halide acids in the space. Seven continuous acid analyzers (CAA) were also used at different locations in the compartment for "real-time" measurements of acids via electrochemical cells.

FIRES AND TEST SCENARIOS

There were 3 fire locations in the machinery space. Table 1 lists the fire specifications used for the Phase 2tests described in the paper. In addition, to the three main fires there were 17 telltale fires (about 3 kW each) located throughout the compartment.

TABLE 1

| Fire Specifications | | | | | |
|---|---|---|---|---|---|
| Fire | Pan Size (m × m) | Pan Area ($m^2$) | Pan Fire Size (MW) | F-76 Diesel Spray Flow Rate (lpm) | F-76 Diesel Spray Fire Size (MW) |
| 1 | 2.44 × 0.91 | 2.23 | 4.5[a] | 5.7–7.9 | 3.3–4.7[a] |
| 2 | — | — | — | 0.7–0.8 | 0.09–0.1 |
| 4 | — | — | — | 0.7–0.8 | 0.09–0.1 |

[a]- The pan fire preburn just overlapped the spray fire preburn in time.

TEST SERIES

The Phase 2 testing consisted of seven series of tests. Series' particulars are listed in Table 2 and particulars for the tests analyzed in this paper are listed in Table 3. Fire suppression tests used HFP at 10.1% design concentration (Series 3–5), or Halon 1301 at 5.2% design concentration (Series 6).

RESULTS

Fire Suppression and Reignition Prevention

All fires were extinguished for each scenario tested. A preliminary summary of Series 3–6 test results is shown in Table 0 3. These data are based on visual observation of IR video. Reignitions were attempted at Fires 2 and 4. The attempts were performed every minute until a successful reignition occurred. No attempts were made after the first 5 minutes of venting. Preliminary results indicate that WSCS introduction prior to agent discharge as well as during the venting enhances reignition protection. Also, at the agent design concentrations tested Halon 1301 provided better reignition protection than HFP.

Although there was no dramatic difference in overhead relative temperature decreases (see the section below on Temperature Reduction) between Tests 4.2 and Test 3.6 (no WSCS), the introduction of the WSCS during venting prevented a sustained reignition (Test 3.6) and resulted in only a brief reignition lasting 3 seconds.

Temperature Reduction

WSCS Not Used

Figure 2:
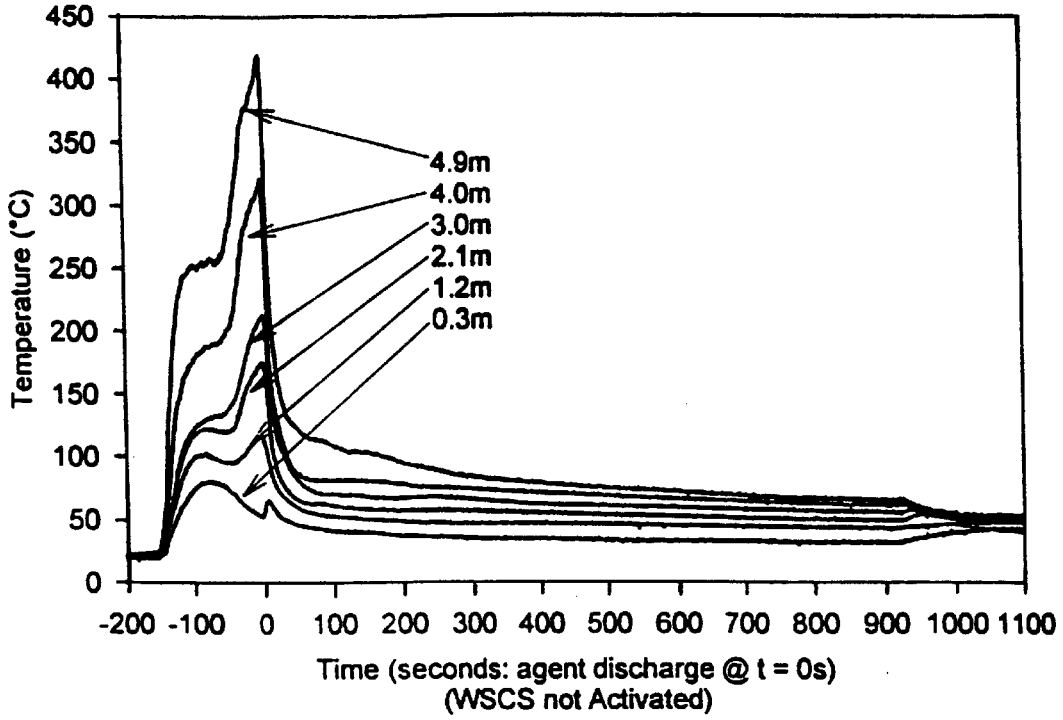
FIG. 2 shows the measured temperatures from the aft thermocouple tree during a test of a prior art fire suppression method.

FIG. 2 shows the measured temperatures from the aft thermocouple tree during Test 3.6. The introduction of the agent in the compartment (flash cooling) and the suppression of the fires reduced the ambient temperatures. The maximum measured temperature (aft thermocouple tree) did not decrease to 100° C. until 180 seconds after agent discharge initiation.

WSCS Initiated At Same Time As Agent Discharge

Figure 3:
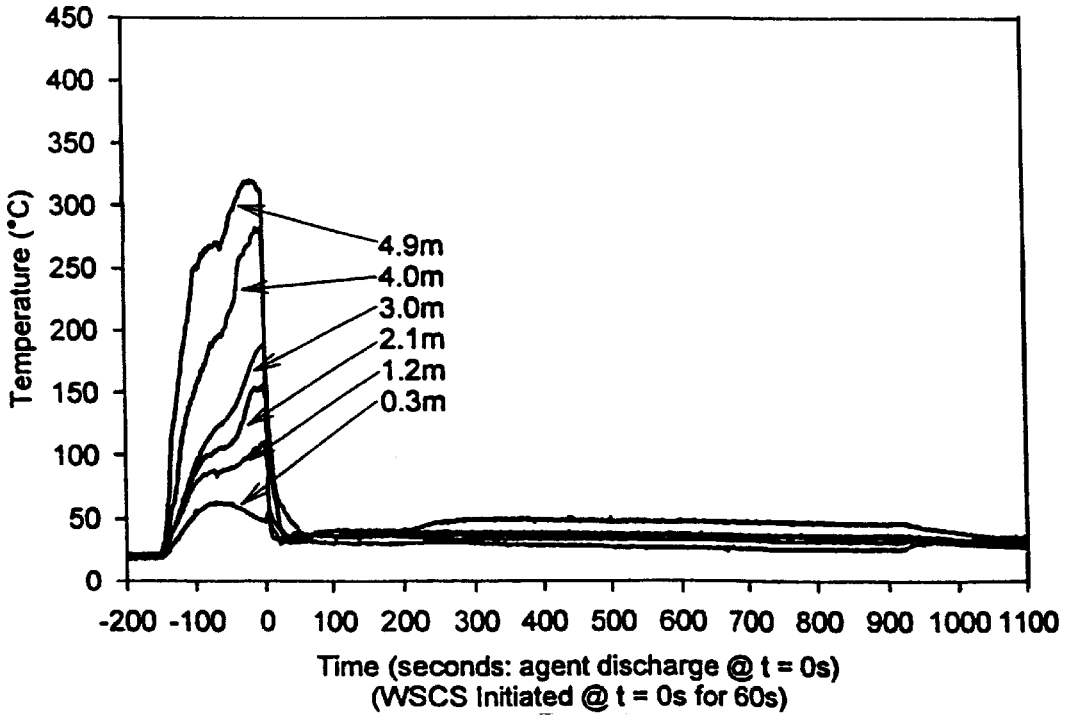
FIG. 3 shows the measured temperatures from the aft thermocouple tree during a test of simultaneous water spray and introduction of gaseous fire suppression agent.

For Test 4.5 (FIG. 3) the WSCS was initiated simultaneously with the gaseous agent discharge. The WSCS was run for 60 seconds at a WSCSAR of 60 gallons per minute (gpm). Within 40 seconds after discharge initiation all aft thermocouple tree temperatures were below 50° C. The cooling effect of the WSCS is clearly visible.

WSCS Initiated Before Agent Discharge

Figure 4:
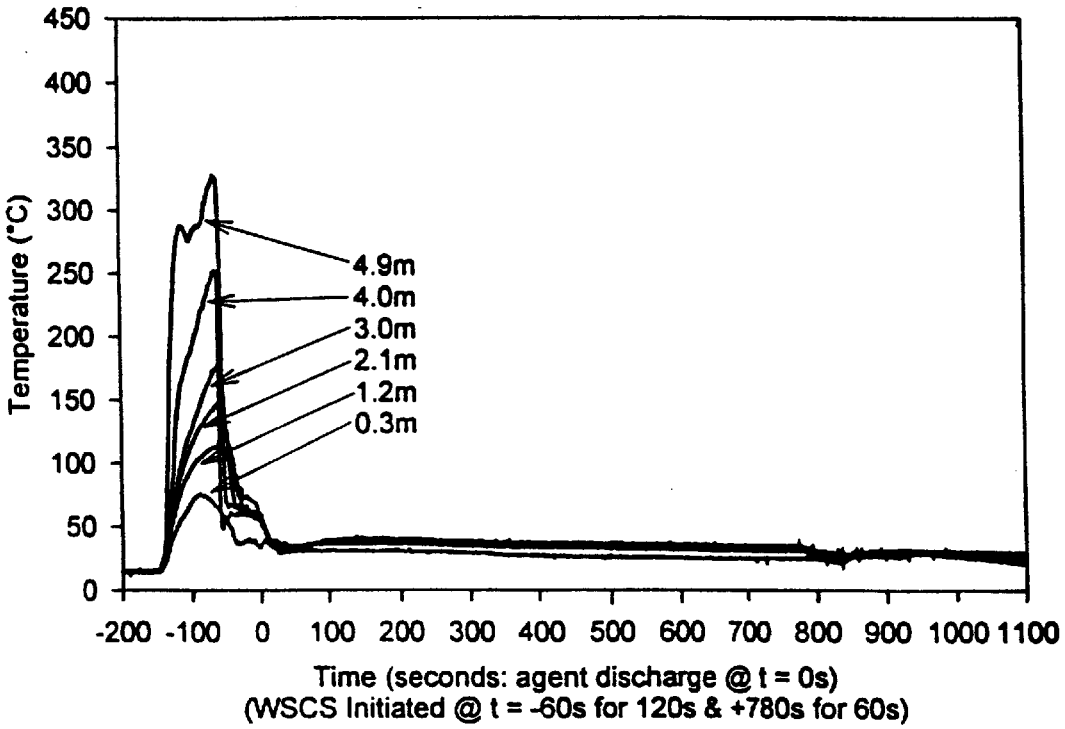
FIG. 4 shows measured temperatures from the aft thermocouple tree during a test of a method of fire suppression according to an embodiment of the present invention wherein the water spraying begins before and ends shortly after discharge initiation of fire suppression agent, and then begins again several minutes after initial discharge of the gaseous fire suppression agent.

During Test 5.2 the WSCS was initiated 60 seconds before agent discharge for a 120 seconds application, and at 780 seconds after discharge initiation for a 60 seconds application. FIG. 4 shows the measured temperatures from the aft thermocouple tree. The peak temperature from the aft thermocouple tree was measured 320° C. just prior to WSCS activation. The most dramatic temperature reduction is observed in the upper level of the compartment. At agent discharge (60 seconds after WSCS initiation) the peak measured temperature was 60° C. Within 20 seconds after agent discharge initiation the measured aft thermocouple tree temperatures were all below 40° C. In a real shipboard fire, the introduction of the water spray prior to agent discharge would drastically limit flame spread and reduce damage by reducing compartment temperature. Similar WSCS effectiveness is expected when used with other halon-like agents.

WSCS Initiated After Agent Discharge

Figure 5:
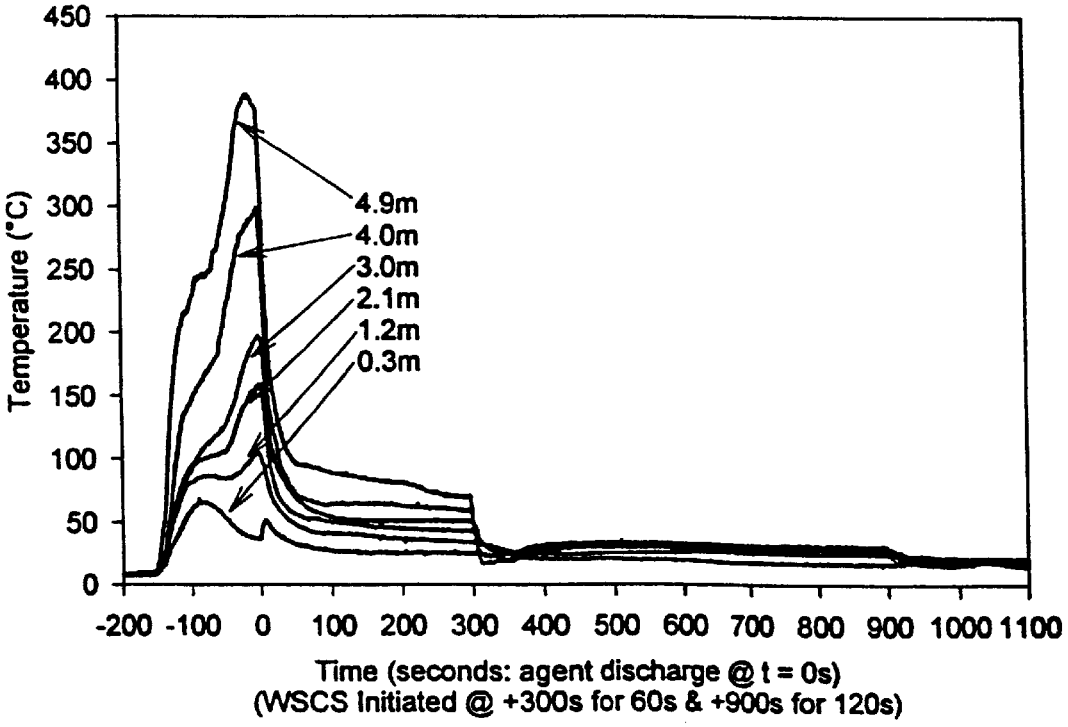
FIG. 5 shows the effect of water spraying on compartment temperature after fire suppression.

The effects on compartment temperature of the WSCS initiation after fire suppression are demonstrated in Test 4.2 (FIG. 5). For this test the first WSCS application was initiated 300 seconds after agent discharge initiation and lasted 60 seconds. A second application, for 120 seconds, was initiated simultaneously with compartment venting at 900 seconds. The first WSCS application reduced overhead temperature from 70° C. to below 40° C. with 20 gallons of water within 20 seconds. The second WSCS application, in conjunction with the venting, reduced the temperature from 35° C., to below 25° C. within 20 seconds compared to a decrease from 65° C. to below 55° C. in 100 seconds for Test 3.6 (no WSCS used).

HF Generation and Mitigation

WSCS Not Used

The reported peak measured values are from one of the Continuous Acid Analyzers (CAA) located in the upper level of the compartment. HF values for HFP tests without the WSCS were 5000 parts per million (ppm) for Test 3.6 and 4100 ppm for Test 4.2. For the Halon 1301 Test 6.1 the measured peak was 1100 ppm. The higher HF generated values associated with HFP are consistent with Phase 1 testing.

WSCS Initiated At Same Time As Agent Discharge

The initiation of the WSCS at the same time as agent discharge (Test 4.5) limited HF generation to a peak value of 1800 ppm, compared to values over 4000 ppm for tests without WSCS.

WSCS Initiated Before Agent Discharge

Figure 6:
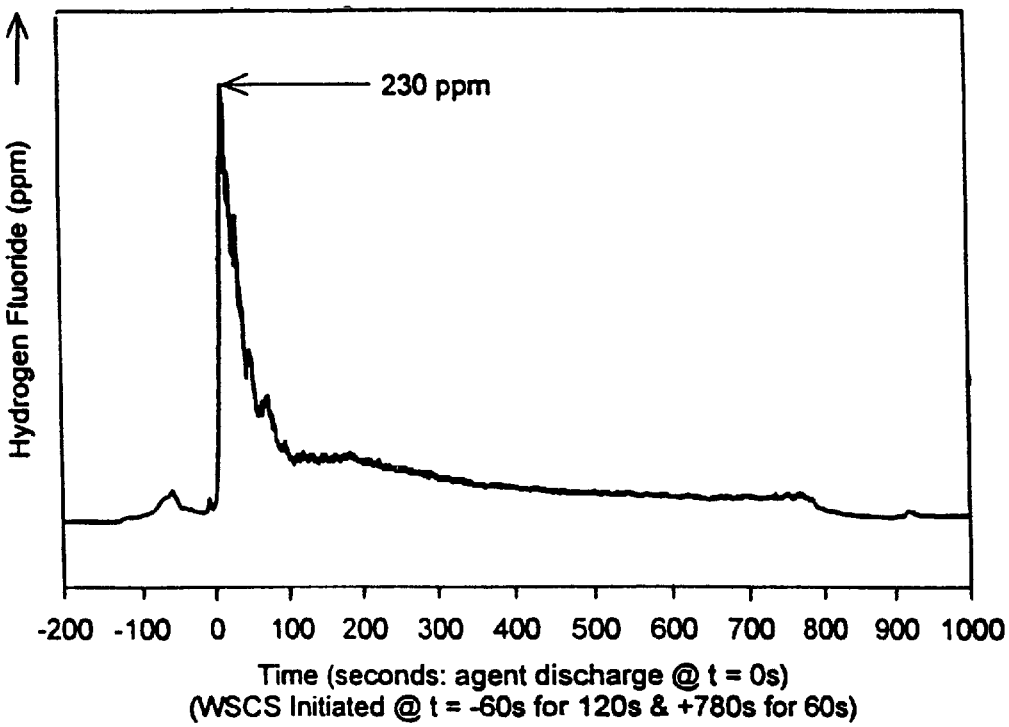
FIG. 6 shows the effects of water spraying, prior to discharge of a gaseous fire suppression agent, on compartment HF levels.

The initiation of the WSCS one minute prior to agent discharge (Test 5.2) limited HF generation to a peak value of 200 ppm (FIG. 6), compared to values over 4000 ppm for tests without WSCS. Similarly for Halon 1301, for Test 6.2 (with WSCS initiation at −60 seconds) peak HF recorded value was 200 ppm compared to 1100 ppm for the test without the WSCS. This drastic drop in HF peak values is a result of flame inhibition and lower flame temperatures resulting from the oxygen displacement associated with the conversion of water to steam and the reduced compartment air temperatures.

WSCS Initiated After Agent Discharge

Figure 7:
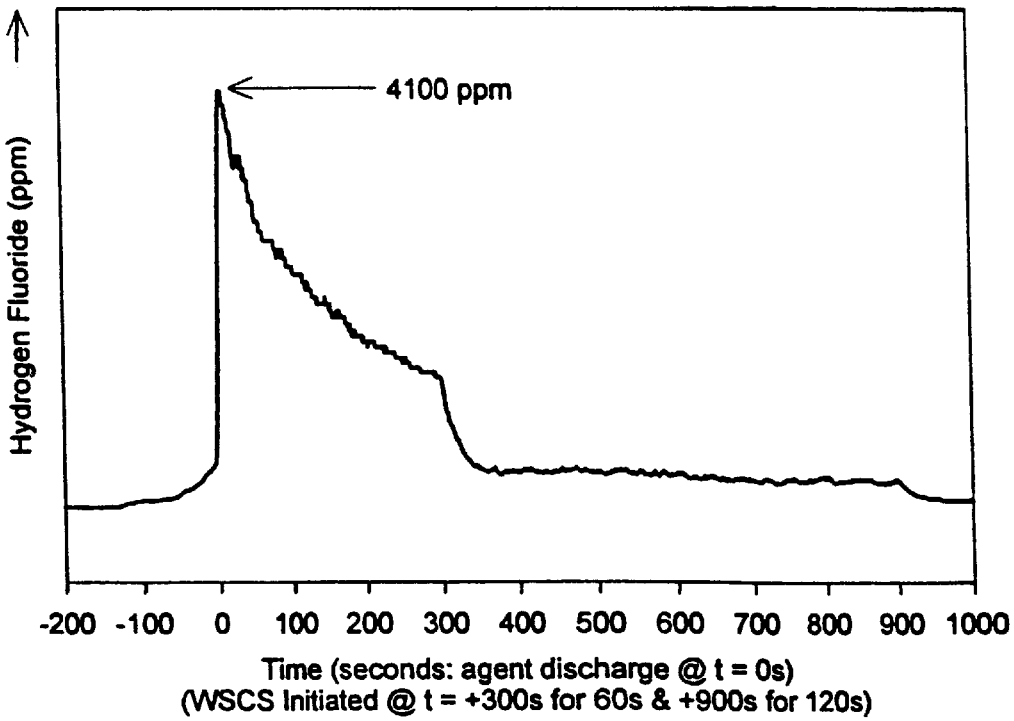
FIG. 7 shows the scrubbing performance of water spraying initiated after discharge of the gaseous fire suppression agent.

The capability of the WSCS to scrub or remove HF from the air was examined during Test 4.2 where the WSCS was initiated 300 seconds after agent discharge. The HF concentration drop at 300 seconds in FIG. 7 illustrates the WSCS acid scrubbing performance.

TABLE 2

Test Series Overview

| Series No. | Agent | Discharge System | Number of Nozzles | Fires | WSCS Application: Before Agent Discharge | During Agent Discharge | Prior/ During Venting | Hold Time (time prior to venting) (min) |
|---|---|---|---|---|---|---|---|---|
| 1 | No | No | No | Yes | No | No | No | — |
| 2 | HFP | Standard Navy | 4, 8 | No | No | No | No | 30 |
| 3 | HFP | Standard Navy | 4 | Yes | No | No | No | 5, 15, 30 |
| 4 | HFP | Standard Navy | 4 | Yes | No | Yes | Yes/No | 15 |
| 5 | HFP | Standard Navy | 4 | Yes | Yes | Yes | Yes/No | 15 |
| 6 | Halon 1301 | Standard Navy | 4 | Yes | Yes/No | Yes/No | Yes/No | 15 |
| 7 | HFP | Modified[a] | 4 | No | No | No | No | 30 |

[a]- Larger cylinder valve, flexible hose, and check valve compared to Standard U.S. Navy hardware.

TABLE 3

Test Results for HFP Tests Series 3–5 and Halon 1301 Tests Series 6

| Test No. | WSCS Initiation (min:sec) (t = 0 @ discharge) and Duration (min:sec): First Application Initiation | First Application Duration | Second Application Initiation | Second Application Duration | WSCSAR (gpm) | Fire Extinguishment Times (min:sec)[a]: 1 | 2 | 4 | Peak HF Conc.[b] (ppm) | Agent Conc. at Fire 1 @ 5 and 15 sec. (%) | Peak Comp. Temp. (° C.) | Peak Comp. Temp. @ Venting Initiation (° C.) | First Successful Sustained Reignition[c] (Venting Initiated @ 15:00 min): Fire 2 | Fire 4 |
|---|---|---|---|---|---|---|---|---|---|---|---|---|---|---|
| 1.16b | N/A | N/A | N/A | N/A | N/A | d | d | d | N/A | N/A | 400 | N/A | N/A | N/A |
| 3.6 | N/A | N/A | N/A | N/A | N/A | 0:10 | 0:09 | 0:04 | 5000 | 4.4/8.9 | 420 | 70 | No | 17:00 |
| 4.2 | 5:00 | 1:00 | 15:00 | 2:00 | 60 | 0:09 | 0:12 | 0:08 | 4100 | 3.8/10.5 | 390 | 40 | e | N/A |
| 4.5 | 0:00 | 1:00 | N/A | N/A | 60 | 0:09 | 0:11 | 0:16 | 1500 | 3.5/10.2 | 320 | 50 | No | 17:00 |
| 5.2 | −1:00 | 2:00 | 13:00 | 1:00 | 60 | 0:07 | 0:05 | 0:04 | 200 | 3.2/9.3 | 330 | 40 | e | 16:00 |
| 5.3 | −2:00 | 3:00 | N/A | N/A | 60 | 0:06 | 0:05 | −0:36 | 1300 | 4.6/g | f | f | No | 17:00 |
| 5.4 | −1:00 | 2:00 | 15:00 | 2:00 | 40 | 0:09 | 0:12 | 0:07 | 2000 | g | f | f | No | 16:00 |
| 6.1 | N/A | N/A | N/A | N/A | N/A | 0:09 | 0:11 | 0:06 | 1100 | g | f | t | No | 16:00 |
| 6.2 | −1:00 | 2:00 | 15:00 | 2:00 | 60 | −0:06 | 0:04 | −0:46 | 200 | g | f | f | No | 19:00 |

a — Times are determined from visual observations of IR video.
b — HF peaks from Continuous Acid Analyzers.
c — Reignitions attempted for the every minute from agent discharge until a successful reignition was achieved, up to 5 minutes after venting initiation.
d — Fuel to spray fires was secured 10 seconds after discharge initiation would have occurred (control fire- no suppression agent used).
e — None attempted due to equipment failure.
f — Data currently being processed.
g — Data not available.

RESULTS

Results show that the innovative WSCS usage significantly reduced compartment temperatures. Overhead temperature was reduced from over 250° C. to less than 60° C. in less than 5 seconds from WSCS/agent discharge initiation. For comparison, the overhead temperature over the same interval dropped only 50° C. with agent discharge alone. Results also showed that the WSCS dramatically reduced HF generation as well as accelerated the acid decay rate.

Phase 2 preliminary results show that the employed WSCS is a viable option for rapid reduction of compartment temperature. The low water pressure WSCS tested provided very rapid compartment temperature reduction in 15 seconds with less than 20 gallons of water. The ability of the WSCS to run off the ship's firemain or from its own pressurized water tank make it a viable system for shipboard installation.

Compartment reclamation initiation is a function of fire suppression, reignition potential, compartment temperatures and atmospheric acid product concentrations. The firefighting team reentry and compartment reclamation procedures depend on the particulars of a fire scenario: type of space, contents, and fire suppression system. Results show that the WSCS significantly reduced compartment temperatures and is particularly effective when initiated before agent discharge. The compartment temperature reduction as well as the reduced HF generation and subsequent mitigation concentration make the WSCS a viable supplement to a gaseous suppression system. Also, WSCS can enhance a gaseous agent's reignition protection and hence render the compartment safer during reentry and desmoking/venting.

Obviously, many modifications and variations of the present invention are possible in light of the above teachings. It is therefore to be understood that, within the scope of the appended claims, the invention may be practiced otherwise than as specifically described.

What is claimed is:

1. A method of suppressing fire within a compartment, comprising the steps of:

spraying, at a pressure of no more than about 150 psi and before introducing a gaseous fire suppression agent into said compartment, water onto a fire in said compartment, in an amount sufficient to cool the ambient temperature in said compartment to below 100° C., but no greater than the amount required to cool said ambient compartment temperature to 200° C., thus forming a cooled compartment;

introducing a gaseous fire suppression agent into said cooled compartment, in an amount sufficient to extinguish said compartment fire.

2. The method of claim 1, wherein said water is sprayed onto said fire at a pressure of between about 40 and 100 psi.

3. The method of claim 1, wherein said water is sprayed onto said fire at a pressure of between about 60 and 100 psi.

4. The method of claim 1, wherein a majority of droplets in said sprayed water have a droplet size of about 100 $\mu$m to about 200 $\mu$m.

5. The method of claim 1, wherein said water is sprayed at a rate of about 0.0029 to about 0.009 gal/min/ft$^3$.

6. The method of claim 1, wherein said gaseous fire suppression agent is selected from the group consisting of perfluorobutane; a mixture comprising 4.75 volume percent dichlorotrifluoroethane, 82 volume percent chlorodifluoromethane, 9.5 volume percent chlorotetrafluoroethane, and 3.5 volume percent isopropenyl-1-methylcyclohexane; chlorotetrafluoroethane; pentafluoroethane; heptafluoroethane; trifluoromethane; hexafluoropropane; trifluoro458$CF_3I$; 99.9% pure argon; a mixture of 52 volume percent nitrogen, 40 volume percent argon, and 8 volume percent carbon dioxide; and a mixture of 50 volume percent nitrogen and 50 volume percent argon.

7. The method of claim 1, wherein the amount of said water sprayed before introduction of said gaseous fire suppression acent is no more than that required to cool said ambient compartment temperature to about 40° C.

8. The method of claim 1, wherein the amount of water sprayed from the time water spraying begins until said compartment fire has been extinguished is about 2.5 to about 9 gallons per 1000 ft$^3$ of compartment volume.

9. The method of claim 8, wherein said water spraying is continued after the introduction of said gaseous fire suppression agent.

10. The method of claim 9, wherein said water spraying is discontinued within three minutes after said introduction of said gaseous fire suppression agent.

11. The method of claim 10, wherein said water spraying is restarted after said fire has been extinguished.

12. An apparatus for extinguishing fires in a compartment for having combustibles therein, comprising:

at least one water nozzle positioned to discharge a spray of water droplets downward therefrom, said at least one water nozzle being designed to discharge said spray so that a majority of said water droplets have a diameter of from about 100 $\mu$m to about 200 $\mu$m when said nozzle is supplied with water at a rate of about 0.0029 to about 0.009 gallons per minute per cubic foot compartment volume under a pressure of about 40 to about 100 psi;

a water piping and supply system for providing said at least one water nozzle with water at a rate of about 0.0029 to about 0.009 gallons per minute per cubic foot under a pressure of about 40 to about 100 psi;

at least one gas discharge nozzle connected to a supply of a gaseous fire suppression agent;

said water nozzle and said gas discharge nozzle being capable discharging independently of each other.

* * * * *

UNITED STATES PATENT AND TRADEMARK OFFICE

CERTIFICATE OF CORRECTION

PATENT NO. : 5,918,680

DATED : July 6, 1999

INVENTOR(S) : Maranghides et al.

It is certified that error appears in the above-identified patent and that said Letters Patent is hereby corrected as shown below:

ON THE TITLE PAGE

Item 19 , "Maranghides" should be –Sheinson, et al.—

Item [75] Inventors: Ronald S. Sheinson, Silver Spring, Md.; Alexander Maranghides, North Beach, Md.—

Signed and Sealed this

Seventeenth Day of April, 2001

*Attest:*

Nicholas P. Godici

NICHOLAS P. GODICI

*Attesting Officer*

*Acting Director of the United States Patent and Trademark Office*